106-34 AU 118 EX
7/31/84 XR 4,462,834

United States Patent [19]
LaBate

[11] Patent Number: 4,462,834
[45] Date of Patent: Jul. 31, 1984

[54] LADLE COVERING COMPOUND

[76] Inventor: Micheal D. LaBate, 115 Hazen Ave., Ellwood City, Pa. 16117

[21] Appl. No.: 504,817

[22] Filed: Jun. 16, 1983

[51] Int. Cl.[3] ..... B28B 7/34
[52] U.S. Cl. ..... 106/38.28; 75/96; 106/38.27; 106/84; 164/123; 249/111; 249/197; 523/140; 523/145
[58] Field of Search ..... 106/38.27, 38.28, 84; 75/96; 523/140, 145; 249/197, 111; 164/123

[56] References Cited

U.S. PATENT DOCUMENTS

| | | | |
|---|---|---|---|
| 2,786,771 | 3/1957 | Waterhouse et al. | 106/38.28 |
| 3,516,821 | 6/1970 | Neu | 75/96 |
| 3,607,234 | 9/1971 | Shimada et al. | 75/96 |
| 3,630,267 | 12/1971 | Hlinka et al. | 164/82 |
| 3,923,526 | 12/1975 | Takashima | 106/38.28 |
| 4,066,446 | 1/1978 | Peck | 75/96 |
| 4,102,690 | 7/1978 | Koper | 106/38.28 |
| 4,119,468 | 10/1978 | Wiley | 106/38.22 |
| 4,261,750 | 4/1981 | Foster | 106/38.28 |

FOREIGN PATENT DOCUMENTS

| | | |
|---|---|---|
| 57370 | 8/1969 | Poland . |
| 262923 | 5/1970 | U.S.S.R. . |

*Primary Examiner*—Lorenzo B. Hayes
*Attorney, Agent, or Firm*—Harpman & Harpman

[57] ABSTRACT

The exposed surface of a molten metal, ferrous or non-ferrous in a ladle is covered by an expanding insulating ladle covering compound that is capable of absorbing and removing non-metallic inclusions in a predictable volume. The compound includes burnt lime in amounts between 56% and 60% by weight, aluminum dross, including $Al_2O_3$ in amounts between 22% and 30% by weight, fluorspar in amounts between 7% and 9% by weight, and acid treated graphite in amounts between 1% and 4% by weight.

8 Claims, No Drawings

LADLE COVERING COMPOUND

BACKGROUND OF THE INVENTION

1. Technical Field

This invention relates to the transfer and pouring of molten metals such as the pouring of molten iron and steel from a refractory lined bottom pour transfer ladle and the practice of providing a ladle covering compound for heat insulation and absorption of non-metallics from the molten metal in the ladle.

2. Description of the Prior Art

The prior art compounds used in covering molten metals may be seen in U.S. Pat. Nos. 3,516,821, 3,607,234, 3,630,267, 4,066,446, 4,119,468 and 4,261,750. Similar disclosures may be seen U.S.S.R Patent 262,923 and Poland Patent No. 57370. The materials used in the compounds disclosed in these patents vary from the gas generating granules of carbon black and chalk and a wetting agent of U.S. Pat. No. 3,516,821, the Portland cement, fluorspar, Chamotte powder, soda ash and coke breeze of U.S. Pat. No. 3,607,234, the bloated (expanded) fire clay of U.S. Pat. No. 4,066,446, the iron ore, iron oxide, sodium nitrate, lime, sand and finely divided aluminum of U.S. Pat. No. 4,119,468, the vermiculite or pearlite ore and a minimum of acid treated graphite of U.S. Pat. No. 4,261,750 to the slag forming substances of the U.S.S.R and Poland Patents which are essentially Portland cement, fluorite, soda and feldspar.

Some of the prior art compounds depend on the incorporation of exothermic compounds such as disclosed in U.S. Pat. No. 4,261,750 and U.S. Pat. No. 3,630,267 discloses the application of a layer of molten slag of a specified thickness to the molten metal in the ladle.

The present invention provides a compound which in contact with molten metal as an insulating ladle cover, possesses unusual controllable expansion characteristics resulting in an expanded ladle covering that is unusually effective in absorbing non-metallic inclusions from the metal in the ladle and particularly in its ability to avoid saturation by the non-metallic inclusions as the same are moved progressively upward through the expanded ladle covering compound on the surface of the molten metal.

SUMMARY OF THE INVENTION

An expanding ladle covering compound for application to ferrous and non-ferrous molten metals is principally formed from predetermined amounts of burnt lime, aluminum dross, fluorspar and acid treated graphite. Aluminum, clays, grog, kyanite, dolomite, perlite, vermiculite, and diatomaceous earth may be used in place of the aluminum dross. The acid treated graphite may be replaced by perlite ore, mica ore, sodium silicate. Baking soda and crystal ammonia flour may be incorporated in the compound in known amounts to improve the desired expansion volume. The compound forms a virgin instant slag with predetermined absorption abilities enabling it to retain elements coming from a molten metal bath with or without external or mechanical agitation and has the unique ability of an immediate absorption capability with the absorbed non-metallic inclusions progressively moved in the covering compound so as to avoid saturation of the same.

DESCRIPTION OF THE PREFERRED EMBODIMENT

The ladle covering compound in accordance with one embodiment of the invention will upon being placed in a covering layer on the molten metal in a ladle without delay immediately being a controlled expansion substantially increasing the thickness of the covering layer and provide an insulating cover that will substantially maintain the temperature of the metal for a desirable time. More importantly, the expanding ladle covering compound provides an immediate absorption ability with respect to the non-metallic inclusions in the molten metal and its controlled continuing expansion in addition to increasing its insulating factor retains its absorbing ability over a desired period of time substantially greater than the prior art compounds due to the ability of the ladle covering compound and its controlled continuous expansion to absorb non-metallic inclusions from the molten metal without becoming saturated in the areas thereof in contact with the molten metal and those areas thereof immediately adjacent thereto.

The ladle covering compound continuous to absorb non-metallic inclusions from the metal coming in contact therewith and are retained in the compound for a substantially greater period of time than has heretofore believed possible, thus insuring against non-metallic reversion. A typical ladle covering compound formed in accordance with this invention will have an expansion ratio of from 15% 25% by volume. A typical example of the ladle covering compound may comprise burnt lime 58% by weight, aluminum dross 30% by weight, fluorspar 8% by weight and acid treated graphite 4% by weight.

The ladle covering compound of the foregoing example may be advantageously modified by varying the amounts of the materials comprising the composition. For example, the burnt lime may be present in amounts between 56% by weight and 60% by weight, the aluminum dross in amounts between 22% by weight and 30% by weight, the fluorspar in amounts between 7% by weight and 9% by weight and the acid treated graphite in amount between 1% and 4% by weight.

A typical batch formed in accordance with a preferred example of the invention and totaling 3,000 lbs. would therefore incorporate 1,830 lbs. of burnt lime, 930 lbs. of aluminum dross, 230 lbs. of fluorspar and 10 lbs. of acid treated graphite flakes. These materials are thoroughly mixed and may be used as mixed in their granular or powder form for direct application to the hot metal in a ladle. It will occur to those skilled in the art that the amount of the ladle covering material placed on the molten metal also affects the insulation factor and the time factor of the continuously expanding action of the compound and its continuing ability to absorb non-metallic inclusions from the metal.

Alternately, the above-described compound may be formed in board form by the addition of a suitable bonding material which may comprise resin urea formaldehyde or sodium silicate or phenolic resins or other glue-like binders as known in the art.* Appropriately formed boards may be of varying thicknesses and desirable overall perimeter sizes to facilitate handling of the same in placing them on the molten metal in the ladle. In use such boards rapidly disintegrate and form the covering layer, which is immediately capable of absorbing non-metallic inclusions from the molten metal.

*For example 30% by weight.

Those skilled in the art will observe that the material of the ladle covering compound may be varied and one such variation advantageously improving the expansion time and volume may comprise burnt lime 58% by weight, magnesium oxide 1% by weight, silica oxide 3% by weight, fluorspar 7% by weight, iron oxide 1% by weight, aluminum dross 18% by weight and aluminum 12% by weight.

The modified compound may be altered as to the amounts of the several materials of the composition to alter the rate and volume of the expansion resulting within the following ranges: burnt lime between about 56% and 60% by weight, magnesium oxide between about 1% and 2% by weight, silica oxide between about 3% and 5% by weight, fluorspar between about 7% and 9% by weight, iron oxide between about one-half of one percent and 1% by weight, aluminum dross between about 14% and 18% by weight, and aluminum between about 8% and 12% by weight. The increased volume of the ladle covering compound, due to its expansion, amounts to between 15% and 25%. It has been determined the the amount of expansion of the material is determined by the inclusion of certain refractories and treated elements such as pearlite, acid treated graphite, vermiculite, kalin clays and other products that expand under heat, such as baking soda, crystal ammonia and the like. The melting points and the expansion characteristics of each of these materials is used in selecting the variance in the basic composition so that the thickness of the covering compound, the length of the continuing expansion, and the continuing ability of the compound to absorb non-metallic inclusions from the metal may be controlled.

It will occur to those skilled in the art that the ladle covering compound disclosed herein may be used in any melting furnace as an instant artificial slag acting as a metal refining agent.

It will thus be seen that the ladle covering compound disclosed herein when positioned on molten metal in a ladle forms a virgin, instant slag with precalculated absorption abilities capable of retaining non-metallic elements directed thereagainst by the supporting molten metal with or without external or internal agitation.

Although but two embodiments of the present invention have been described in the foregoing specification, it will be apparent to those skilled in the art that various modifications may be made therein without departing from the spirit of the invention and having thus described my invention, what I claim is:

1. A metallurgical ladle covering compound capable of reacting with molten metal to form a rapidly and continuously expanding cover which exhibits a controlled continuing absorption of non-metallic inclusions from said molten metal consisting essentially of 56% to 60% by weight burnt lime, 22% to 30% by weight aluminum dross, 7% to 9% by weight fluorspar and 1% to 4% by weight acid treated graphite.

2. A metallugrical ladle covering compound capable of reacting with molten metal to form a rapidly and continuously expanding cover which exhibits a controlled continuing absorption of non-metallic inclusions from said molten metal consisting essentially of 58% by weight burnt lime, 30% by weight aluminum dross, 8% by weight fluorspar, and 4% by weight acid treated graphite.

3. A metallurgical ladle covering compound capable of reacting with molten metal to form a rapidly and continuously expanding cover which exhibits a controlled continuing absorption of non-metallic inclusions from said metal consisting essentially of 56% to 60% by weight burnt lime, 1% to 2% by weight magnesium oxide, 3% to 5% by weight silica oxide, 7% to 9% by weight fluorspar, 0.5 to 1% by weight iron oxide, 14% to 18% by weight aluminum dross, and 8% to 12% by weight aluminum.

4. A matallurgical ladle covering compound capable of reacting with molten metal to form a rapidly and continuously expanding cover which exhibits a controlled continuing absorption of non-metallic inclusions from said metal consisting essentially of 58% by weight burnt lime, 1% by weight magnesium oxide, 3% by weight silica oxide, 7% by weight fluorspar, 1% by weight iron oxide, 30% by weight aluminum dross containing about 80% $Al_2O_3$.

5. The metallurgical ladle covering compound of claim 1 further containing a binder selected from the group consisting of urea formaldehyde resin, sodium silicate and phenolic resin in amounts sufficient to bond said compound to form boards.

6. The metallurgical ladle covering compound of claim 3 further containing a binder selected from the group consisting of urea formaldehyde resin, sodium silicate and phenolic resin in amounts sufficient to bond said compound to form boards.

7. A metallurgical ladle compound capable of reacting with molten metal to form a rapidly and continuously expanding cover which exhibits a controlled non-saturating absorption of non-metallic inclusions from said metal consisting essentially of about 58% by weight burnt lime, about 30% by weight of at least one of a material selected from the group consisting of aluminum, clay, grog, kyanite, dolomite, perlite, vermiculite and diatomaceous earth, about 8% by weight fluorspar and about 4% by weight of at least one of a material selected from the group consisting of acid treated graphite and mica ore.

8. A metallurgical ladle compound capable of reacting with molten metal to form a rapidly and continuously expanding cover which exhibits a controlled non-saturating absorption of non-metallic inclusions from said metal consisting essentially of about 56% to 60% by weight burnt lime, about 22% to about 30% by weight of at least one of a material selected from the group consisting of aluminum clay, grog, kyanite, dolomite, perlite, vermiculite and diatomaceous earth, about 7% to about 9% by weight fluorspar and about 1% to about 4% by weight of at least one of a material selected from the group consisting of acid treated graphite and mica ore.

* * * * *